US009109424B2

(12) United States Patent
Jefferies et al.

(10) Patent No.: US 9,109,424 B2
(45) Date of Patent: Aug. 18, 2015

(54) GAS LIFT PLUNGER

(71) Applicant: EPIC LIFT SYSTEMS LLC, Fort Worth, TX (US)

(72) Inventors: James Allen Jefferies, Granbury, TX (US); Schuyler Kuykendall, Granbury, TX (US)

(73) Assignee: Epic Lift Systems LLC, Fort Worth, TX (US)

( * ) Notice: Subject to any disclaimer, the term of this patent is extended or adjusted under 35 U.S.C. 154(b) by 0 days.

(21) Appl. No.: 14/226,143

(22) Filed: Mar. 26, 2014

(65) Prior Publication Data

US 2015/0000761 A1 Jan. 1, 2015

Related U.S. Application Data

(60) Provisional application No. 61/840,830, filed on Jun. 28, 2013, provisional application No. 61/873,644, filed on Sep. 4, 2013.

(51) Int. Cl.
*E21B 43/12* (2006.01)
*E21B 34/08* (2006.01)

(52) U.S. Cl.
CPC ..... *E21B 34/08* (2013.01); *E21B 43/121* (2013.01); *Y10T 137/8242* (2015.04)

(58) Field of Classification Search
CPC ... E21B 43/121; E21B 43/128; E21B 43/122; E21B 43/123; F04B 39/0016; F04B 47/00; F04B 47/12; F04C 13/008
USPC ..... 166/372, 68, 105, 106; 417/56, 57, 60, 417/63, 545, 547, 552, 554, 555.1, 555.2, 417/904; 73/152.61, 152.54
See application file for complete search history.

(56) References Cited

U.S. PATENT DOCUMENTS 1,769,637 A 10/1928 Flether et al.
1,784,096 A 7/1929 Fletcher (Continued)

FOREIGN PATENT DOCUMENTS

RU 182634 1/1966
RU 2070278 12/1996

(Continued)

OTHER PUBLICATIONS

Jefferies et al., U.S. Appl. No. 13/872,642, filed Apr. 26, 2013, titled "Plunger Lift Apparatus."

(Continued)

*Primary Examiner* — Shane Bomar
*Assistant Examiner* — Wei Wang
(74) *Attorney, Agent, or Firm* — MH2 Technology Law Group, LLP

(57) ABSTRACT

Gas lift plungers and methods are provided. The gas lift plunger includes a body including a first end, a second end, a valve seat extending from the first end, and a bore extending between the valve seat and the second end. The gas lift plunger also includes a valve element configured to be received through the bore. The valve element includes a first end, a second end, and a valve-engaging portion extending radially outward from a main portion of the valve element. The valve element is movable in the bore between an open position and a closed position. In the closed position, the valve-engaging portion engages the valve seat, and the valve element extends through the second end of the. Further, in the open position, the valve-engaging portion is separated from the valve seat, allowing fluid communication through the bore.

34 Claims, 7 Drawing Sheets

(56) References Cited

U.S. PATENT DOCUMENTS

| | | | | |
|---|---|---|---|---|
| 1,896,232 | A | 11/1931 | Flecher | |
| 1,932,992 | A | 10/1933 | Sherman et al. | |
| 2,001,012 | A | 5/1935 | Burgher | |
| 2,001,552 | A | 5/1935 | Scott | |
| 2,013,111 | A | 9/1935 | Scott | |
| 2,018,204 | A | 10/1935 | Evans et al. | |
| 2,237,408 | A | 4/1941 | Burgher | |
| 2,301,319 | A | 11/1942 | Peters | |
| 2,539,000 | A | 1/1951 | Williams | |
| 2,642,002 | A | 6/1953 | Knox et al. | |
| 2,661,024 | A | 12/1953 | Knox | |
| 2,676,547 | A | 4/1954 | Knox | |
| 2,699,121 | A | 1/1955 | Knox | |
| 2,821,142 | A | 1/1958 | Knox | |
| 2,970,547 | A | 5/1958 | McMurry | |
| 2,962,978 | A | 8/1958 | Reeves | |
| 2,878,754 | A | 3/1959 | McMurry | |
| 2,884,861 | A | 5/1959 | Vincent et al. | |
| 2,918,015 | A | 12/1959 | Knox | |
| 3,012,513 | A | 12/1961 | Knox | |
| 3,020,852 | A | 2/1962 | Roach et al. | |
| 3,031,971 | A | 5/1962 | Roach | |
| 3,090,315 | A | 5/1963 | Milton | |
| 3,095,819 | A | 7/1963 | Brown et al. | |
| 3,146,725 | A | 9/1964 | Harris | |
| 3,147,808 | A | 9/1964 | McCarvell et al. | |
| 3,329,211 | A | 7/1967 | Roach | |
| 3,473,611 | A | 10/1969 | Gregston | |
| 3,968,839 | A | 7/1976 | Swihart, Sr. | |
| 4,150,721 | A | 4/1979 | Norwood | |
| 4,211,279 | A | 7/1980 | Isaacks | |
| 4,352,376 | A | 10/1982 | Norwood | |
| 4,417,858 | A | 11/1983 | Stout | |
| 4,502,843 | A | 3/1985 | Martin | |
| 4,596,516 | A | 6/1986 | Scott et al. | |
| 4,889,473 | A | 12/1989 | Krueger | |
| 4,898,235 | A | 2/1990 | Enright | |
| 4,921,048 | A | 5/1990 | Crow et al. | |
| 4,923,372 | A | 5/1990 | Ferguson et al. | |
| 5,132,904 | A | 7/1992 | Lamp | |
| 5,146,991 | A | 9/1992 | Rogers, Jr. | |
| 5,253,713 | A | 10/1993 | Gregg et al. | |
| 5,427,504 | A | 6/1995 | Dinning et al. | |
| 5,957,200 | A | 9/1999 | Majek et al. | |
| 5,984,013 | A | 11/1999 | Giacomino et al. | |
| 6,045,335 | A | 4/2000 | Dinning | |
| 6,059,040 | A | 5/2000 | Levitan et al. | |
| 6,148,923 | A | 11/2000 | Casey | |
| 6,176,309 | B1 | 1/2001 | Bender | |
| 6,209,637 | B1 | 4/2001 | Wells | |
| 6,467,541 | B1 | 10/2002 | Wells | |
| 6,644,399 | B2 | 11/2003 | Abbott et al. | |
| 6,688,385 | B1 | 2/2004 | Moe | |
| 6,719,060 | B1 | 4/2004 | Wells | |
| 7,270,187 | B2 | 9/2007 | Shulyatikov et al. | |
| 7,383,878 | B1 * | 6/2008 | Victor | 166/68 |
| 7,397,388 | B2 * | 7/2008 | Huang et al. | 340/853.3 |
| 7,438,125 | B2 | 10/2008 | Victor | |
| 8,181,706 | B2 | 5/2012 | Tanton | |
| 8,286,717 | B2 * | 10/2012 | Giroux et al. | 166/382 |
| 8,464,798 | B2 | 6/2013 | Nadkrynechny | |
| 8,627,892 | B2 | 1/2014 | Nadkrynechny | |

FOREIGN PATENT DOCUMENTS

| | | | |
|---|---|---|---|
| SU | 63138 | A1 | 11/1943 |
| SU | 171351 | A1 | 1/1965 |
| SU | 182634 | A1 | 1/1966 |
| SU | 1174595 | | 8/1985 |

OTHER PUBLICATIONS

Hirschfeldt, Marcelo et al. Artificial-Lift Systems Overview and Evolution in a Mature Basin: Case Study of Golfo San Jorge. SPE International, 2007, pp. 1-13.

Lestz, Robert et al. Two-piece, flow-thru plunger offers benefits for unloading gas wells. Petroleum Technology Digest, Aug. 2003, pp. 1-3.

Shulyatikov, I.V. et al. Improved Technology of Removing Liquid From Wells of Gas and Gas-Condensate Fields at Declining Production Period by Flying Valves. 22nd World Gas Conference, 2003, pp. 1-4.

Medko, V. Operation of Wells on the Medvezhie Gas Field on the Basis of Plunger Lift at a Final Stage of the Field Development. 23rd World Gas Conference, Amsterdam 2006, pp. 1-13.

Author Unknown, "Installing Plunger Lift Systems in Gas Wells", Lessons Learned from Natural Gas STAR Partners, United States Environmental Protection Agency, Oct. 2006, pp. 1-14.

E. Beauregard et al., "Introduction to Plunger Lift: Application, Advantages and Limitations", Presented at the Southwestern Petroleum Short Course Department of Petroleum Engineering Texas Tech University, Lubbock, Texas, Apr. 23-24, 1981, pp. 1-10.

Dan Phillips et al., "Plunger lift with wellhead compression boosts gas well production", World Oil, Oct. 1986, pp. 96-100.

Dan Phillips et al., "How to optimize production from plunger lift systems", World Oil, Apr. 1998, pp. 110-120.

Dan Phillips et al., "How to optimize production from plunger lift systems", World Oil, May 1998, pp. 67-72.

A.A. Popov, "Experience in Introducing Plunger Lift at Fields of the Ukhta Complex", Gazovoe delo, No. 9, 1968, pp. 23-26.

I. Shulyatikov et al., "Removing Liquid from Gas Wells by Well Shuttles", Corrosion & Prevention—2001, Sep. 29-Oct. 2, 2002, pp. 1-7.

James Lea et al., "Gas Well Dequalification Solutions to Gas Well Liquid Loading Problems", Gulf Drilling Guides, 2003, pp. 1-321.

James Lea et al., "Gas Well Dequalification Second Edition", Gulf Drilling Guides, 2008, pp. 1-605.

G.V. Chilingarian et al., "Surface operations in petroleum production, I", Developments in Petroleum Science, 19A, 1987, pp. 466-476, 515-517, and 529-530.

Author Unknown, Pacemaker Pungers, IPS Pacemaker, brochure, pp. 1-2.

Author Unknown, Plunger Lift Systems, NOV Monoflo, 2013, pp. 1-8.

Author Unknown, IPS (Integrated Production Services) Catalog, pp. 1-42.

Arie Janssens et al., Clinton Sandstone Papers, Presented at The Ohio Oil and Gas Association Winter Meetings 1961 to 1978, Abridged Reprint, 1985, pp. 1-215.

Author Unknown, "How to Make More Production with Plunger Lift", Harbison-Fischer Opti-Miser Well Controll System, Developing Unconventional Gas Technical Workshop, Mar. 29, 2010, pp. 1-29.

David Cosby, P.E., "Introduction to Plunger Lift", Gas Well Dequalification Workshop, Feb. 24-26, 2014, pp. 1-43.

Divyakumar O. Garg, B.E., "New Modeling Techniques for Two-Piece Plunger Lift Components", A Thesis in Petroleum Engineering, Texas Tech University, Dec. 2004, pp. 1-103.

Author Unknown, Subsurface Equipment—Plungers, Ferguson Beauregard, web page, http://www.fbdover.com/products/plungers/subsurface-equipment, accessed Mar. 27, 2014, 1 page.

Author Unknown, Shuttle Ball Plunger, Pro-Seal Lift Systems, 2013, http://prosealinc.com/plunger-lift/shuttle-ball-plunger/, accessed Feb. 21, 2014, 1 page.

Author Unknown, Bypass Plungers, Pro-Seal Lift Systems, 2013, http://prosealinc.com/plunger-lift/bypass-vs-non-bypass/, accessed Feb. 21, 2014, 1 page.

Author Unknown, "Which plunger is right for my well?", Shale Tec, LLC, 2014, http://www.shaletec.com/faq/which-plunger-is-right-for-my-well/, accessed Feb. 21, 2014, pp. 1-4.

G.I. Zadora, "Gas Production Operator", Recommended by the Central Scientific and Methodological Office of the Ministry of Gas Industry as a Textbook to Train and Develop Industry Personnel, Moscow, Nedra, 1980, pp. 1-10 (including translation).

* cited by examiner

GAS LIFT PLUNGER

CROSS-REFERENCE TO RELATED APPLICATIONS

This application claims priority to U.S. Provisional Patent Application having Ser. No. 61/840,830, filed on Jun. 28, 2013, and to U.S. Provisional Patent Application having Ser. No. 61/873,644, filed on Sep. 4, 2013. Each of these provisional patent applications is incorporated herein by reference in its entirety.

BACKGROUND

Gas lift plungers are employed to facilitate removal of gas from wells, addressing challenges incurred by "liquid loading." In general, a well may produce liquid and gaseous elements. When gas flow rates are high, the gas carries the liquid out of the well as the gas rises. However, as well pressure decreases, the flowrate of the gas decreases to a point below which the gas fails to carry the heavier liquids to the surface. The liquids thus fall back to the bottom of the well, exerting back pressure on the formation, and thereby loading the well.

Plungers alleviate such loading by assisting in removing liquid and gas from the well, e.g., in situations where the ratio of liquid to gas is high. In operation, the plunger descends to the bottom of the well, where the loading fluid is picked up by the plunger and is brought to the surface as the plunger ascends in the well. The plunger may also keep the production tubing free of paraffin, salt, or scale build-up.

During the plunger's descent to the bottom of the well (e.g., to a bumper assembly at the bottom of the production tubing), a bypass valve of the plunger is generally maintained in an open position, allowing the plunger to descend through the column of gas and liquids in the tubing. The plunger thus moves toward the bottom, sinking past liquid accumulations, etc. Once the plunger reaches the bottom of the well, the bypass valve is closed. The outer diameter of the plunger may seal with the production tubing, and thus, with the bypass valve closed, pressure below the plunger may serve to push the plunger upwards. As the plunger moves upwards, it clears the production tubing of liquid, allowing the gas to be produced.

SUMMARY

Embodiments of the disclosure may provide a gas lift plunger. The gas lift plunger includes a body including a first end, a second end, a valve seat extending from the first end, and a bore extending between the valve seat and the second end. The gas lift plunger also includes a valve element configured to be received through the bore. The valve element includes a first end, a second end, and a valve-engaging portion extending radially outward from a main portion of the valve element. The valve element is movable in the bore between an open position and a closed position. When the valve element is in the closed position, the valve-engaging portion of the valve element engages the valve seat, and the valve element extends through the second end of the body such that the second end of the valve element is outside of the bore. When the valve element is in the open position, the valve-engaging portion of the valve element is separated from the valve seat, allowing fluid communication through the bore.

Embodiments of the disclosure may also provide an apparatus for lifting gas from a well. The apparatus includes a body including a first end and a second end, with the body also defining a bore extending between and communicating with the first end and the second end. The body further also includes a valve seat at the first end and a choke extending into the bore. The body also includes a valve element that is movable between an open position and a closed position. In the closed position, the valve element engages the valve seat, to substantially prevent fluid flow through the bore. In the open position, the valve element is separated from the valve seat, allowing fluid to flow through the bore.

Embodiments of the disclosure may also provide a method. The method may include configuring a gas lift plunger such that a valve element thereof descends to a distal terminus of a well before a body of the gas lift plunger. The body defines a bore through which the valve element is received. The method may also include deploying the gas lift plunger in the well such that the body and the valve element separate proximal an upper terminus of the well, come together at the distal terminus of the well, and ascend together with the valve element in a closed position. The method may further include providing an upper terminus that bears on the valve element so as to move the valve element from the closed position to an open position. The valve element extends completely through the body so as to engage the upper terminus prior to the body reaching the upper terminus.

These and other aspects of the disclosure will be described in greater detail below. Accordingly, it will be appreciated that the foregoing summary is intended merely to introduce a subset of the aspects described below and is, therefore, not to be considered limiting on the present disclosure.

BRIEF DESCRIPTION OF THE DRAWINGS

The accompanying drawings, which are incorporated in and constitutes a part of this specification, illustrate an embodiment of the present teachings and together with the description, serve to explain the principles of the present teachings. In the figures.

Figure 1:
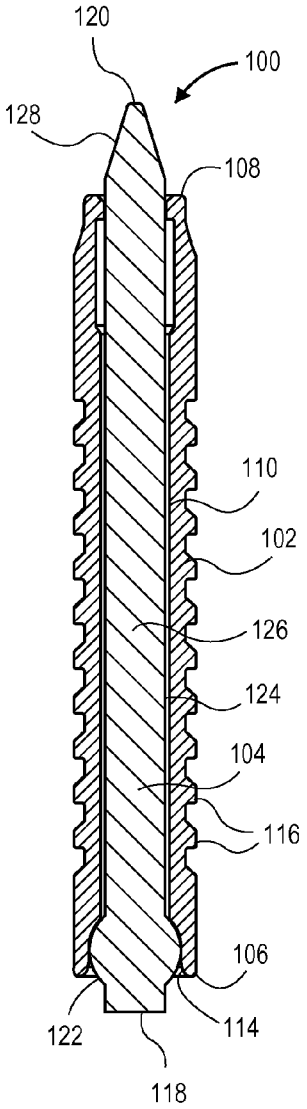
FIG. 1 illustrates a side-cross sectional view of a gas lift plunger, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawings that form a part of the description, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

Additionally, when referring to a position or direction in a well, the terms "above," "up," "upward," "ascend," and various grammatical equivalents thereof may be used to refer to a position in a well that is closer to the surface than another position, or a movement or direction proceeding toward the surface (topside), without regard as to whether the well is vertical, deviated, or horizontal. Similarly, when referring to a position in a well, the terms "below," "down," "downward," and "descend" and various grammatical equivalents thereof may be used to refer to a position in a well that is farther from the surface than another position, or a direction or movement proceeding away from the surface, regardless of whether the well is vertical, deviated, or horizontal. Moreover, the terms "upper," "lower," "above," and "below," when referring to components of an apparatus, are used to conveniently refer to the relative positioning of components or elements, e.g., as illustrated in the drawings, and may not refer to any particular frame of reference. Thus, a component may be flipped or viewed in any direction, while parts thereof may remain unchanged in terms of being "upper" or "lower" etc.

Referring now to the illustrated embodiments, FIG. 1 depicts a side cross-sectional view of a gas lift plunger 100, according to an embodiment. In some embodiments, the gas lift plunger 100 may be configured for deployment into a production tubing disposed in a well, with bumpers on the topside and bottom of the production tubing providing the upper terminus and distal terminus, respectively, of the path for the gas lift plunger 100. However, it will be appreciated that the gas lift plunger 100 may be suitable for use in a variety of other applications, contexts, etc. and/or in other types of tubulars.

The gas lift plunger 100 includes a body 102 and a valve element 104. The body 102 may be generally cylindrical, and shaped to be received into production tubing, or any other cylindrical structure. Further, the body 102 has a first or "lower" end 106, a second or "upper" end 108, and a bore 110 extending between the first and second ends 106, 108. The valve element 104 may be generally shaped as a rod and received into the bore 110, as shown. Further details of the valve element 104, according to one or more embodiments, are provided below.

Figure 2:
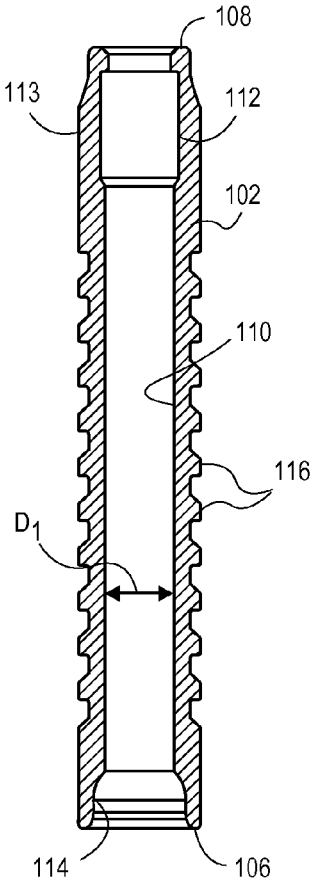
FIG. 2 illustrates a side-cross sectional view of a body of the gas lift plunger of FIG. 1, according to an embodiment.

Additional reference is now made to FIG. 2, which illustrates a side cross-sectional view of the body 102, with the valve element 104 omitted from view. As shown, the bore 110 may communicate with the first and second ends 106, 108. Moreover, the bore 110 may define a nominal diameter D1, which may be generally constant through at least a majority of the axial extent of the body 102, at least in one embodiment. However, departures from a constant value for the diameter D1 are contemplated. For example, proximal to the second end 108, the bore 110 may include an enlarged section 112. The enlarged section 112 may extend through a fishing neck 113 of the body 102.

The body 102 may define a valve seat 114 at or proximal to (e.g., extending from) the first end 106. In an embodiment, the valve seat 114 may be defined as at least a portion of a sphere. For example, the valve seat 114 may be hemispherical. In other embodiments, the valve seat 114 may be conical or provided in any other suitable shape.

The first and second ends 106, 108 of the body 102 may be open, providing fluid communication through the body 102 via the bore 110. Additionally, the body 102 may include tube-engaging structures 116. In the illustrated embodiment, the tube-engaging structures 116 may be or include sidewall rings with grooves positioned therebetween; however, in other embodiments, the tube-engaging structures 116 may include spring-loaded pads, shifting rings, brushes, etc., as are generally known in the art. The illustrated tube-engaging structures 116 may form at least a partial seal with the production tubing, when deployed, and may scrape, brush, wick, or otherwise remove liquid, paraffin, and/or other elements, from the production tubing.

Referring again to FIG. 1, the valve element 104 may include a first end 118 and a second end 120. Further, the valve element 104 may include a valve-engaging portion 122, which may extend outward from an outer diameter 124 of a main portion 126 of the valve element 104. The valve element 104, including the valve-engaging portion 122, may be formed integrally, from a single piece of cast, forged, milled, or otherwise-formed material. In other cases, the valve element 104 may include a plurality of joints or segments that are coupled together, e.g., in a modular, expandable, telescoping, or any other configuration that may provide an adjustable length, a selectable valve-engaging portion 122, etc.

In particular, the valve element 104 may be sized and shaped to engage (e.g., form a seal with) the valve seat 114. Accordingly, in an embodiment in which the valve seat 114 is hemispherical (or otherwise formed as some portion of a sphere), the valve-engaging portion 122 may likewise be formed as part of a sphere. In some cases, the valve-engaging portion 122 may be generally ball-shaped, but in others may be hemispherical. In still other cases, the valve-engaging portion 122 may be conical or otherwise shaped complementarily to the valve seat 114.

The increased mass and/or other properties associated with the ball or otherwise-shaped, enlarged valve-engaging portion 122 near the first end 118 of the valve element 104 may provide an increased rate of descent of the valve element 104 and/or may lower the center of gravity of the valve element 104. Lowering the center of gravity may promote the valve element 104 landing on (e.g., on a bumper at the distal terminus of the production tubing) its first end 118 and standing upright in the production tubing. In some cases, the valve-engaging portion 122 may be inlaid with or otherwise include higher-density materials than the material(s) from which a remainder of the valve element 104 is made.

The main portion 126 of the valve element 104 may extend from the valve-engaging portion 122 to a tapered portion 128.

The tapered portion 128 may be proximal to the second end 120 and may, for example, terminate at the second end 120. The tapered portion 128 may, as shown, define a generally conical surface that decreases in diameter from the main portion 126 to the second end 120. The tapered portion 128 may be provided to facilitate re-entry of the valve element 104 into the bore 110 at the "bottom" of the production tubing, as will be described in further detail below.

The configuration of the gas lift plunger 100 shown in FIG. 1 may be referred to as a "closed position" of the valve element 104 (and/or of the gas lift plunger 100). In this position, with the valve-engaging portion 122 engaging (e.g., forming a seal with) the valve seat 114, and the tube-engaging structures 116 engaging the surrounding production tubing (not shown), fluids may be at least substantially prevented from flowing past the gas lift plunger 100 in the production tubing. Moreover, in the closed position, the valve element 104 may extend through the second end 108 of the body 102, such that the second end 120 of the valve element 104 is located outside of the bore 110, e.g., above the body 102, as shown. Although illustrated with the entire tapered portion 128 extending upward from the second end 108 of the body 102, it will be appreciated that part of the main portion 126 may also extend through the second end 108 and/or only a fraction of the tapered portion 128 may extend therethrough.

The extent to which the valve element 104 extends through the second end 108 of the body 102 may depend on the relative length of the main portion 126 of the valve element 104 and the distance between the bottom of the valve seat 114 and the second end 108 of the body 102. Thus, it will be appreciated that the extent to which the valve element 104 extends outward through the second end 108 in the closed position may be adjusted, e.g., by selecting a valve element 104 having an appropriately-sized main portion 126, by extending the main portion 126 (e.g., in embodiments in which the valve element 104 is adjustable), or by using an axially shorter body 102.

Figure 3:
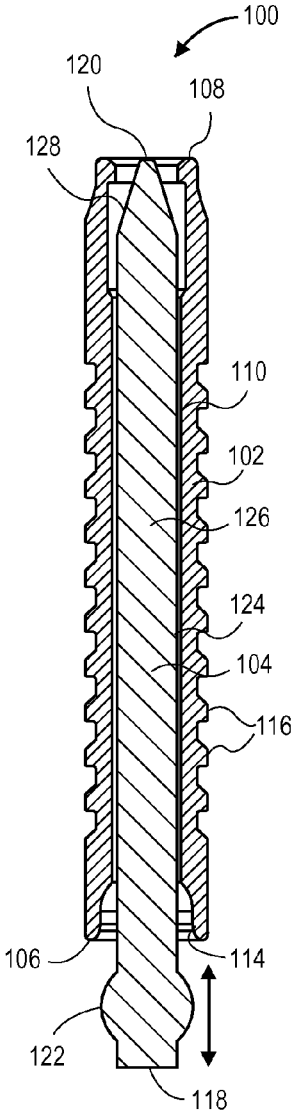
FIG. 3 illustrates a side-cross sectional view of the gas lift plunger of FIG. 1, with a valve element thereof in an open position, according to an embodiment.

FIG. 3 illustrates a side-cross sectional view of the gas lift plunger 100 in an open position, according to an embodiment. As shown, the valve element 104 may be slid or otherwise shifted downwards, relative to the body 102, so as to separate the valve-engaging portion 122 from the valve seat 114. As such, a flowpath may be defined radially between the outer diameter 124 of the valve element 104 and the bore 110, e.g., in a generally annular clearance therebetween. Thus, fluid communication between an area below the gas lift plunger 100 and an area above the gas lift plunger 100, which may have been prevented by the gas lift plunger 100 in the closed position, may be restored through the bore 110.

An example of operation of the embodiment illustrated in FIGS. 1-3 may now be appreciated with additional reference to FIGS. 11A-D. The gas lift plunger 100 may operate in a cyclical manner in a production tubing 700 in a well, serving to lift gas and/or liquid from the well toward a wellhead 702. The wellhead 702 may include one or more valves, etc., configured to control production and/or provide any other suitable functions.

Figure 11D:
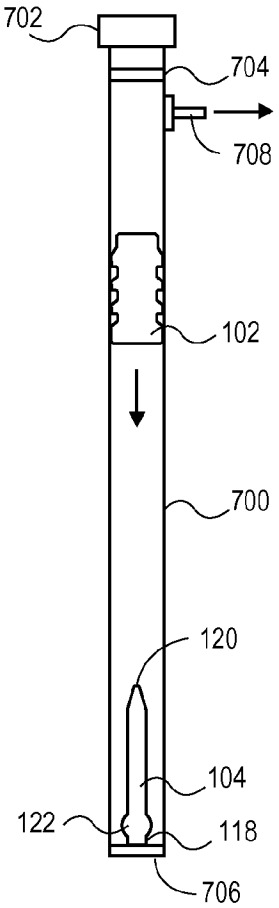
FIGS. 11A-D illustrate schematic views of an embodiment of the gas lift plunger deployed into a well, depicting a sequence of operation, according to an embodiment.
Figure 11C:
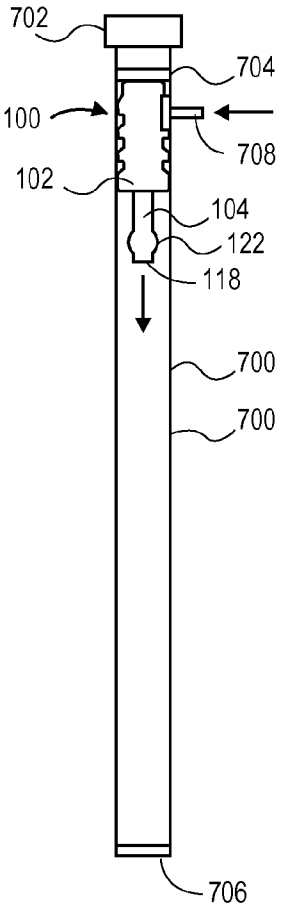
Figure 11B:
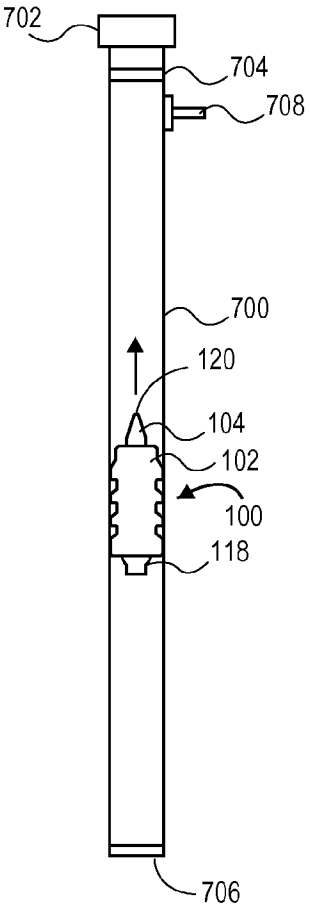
Figure 11A:
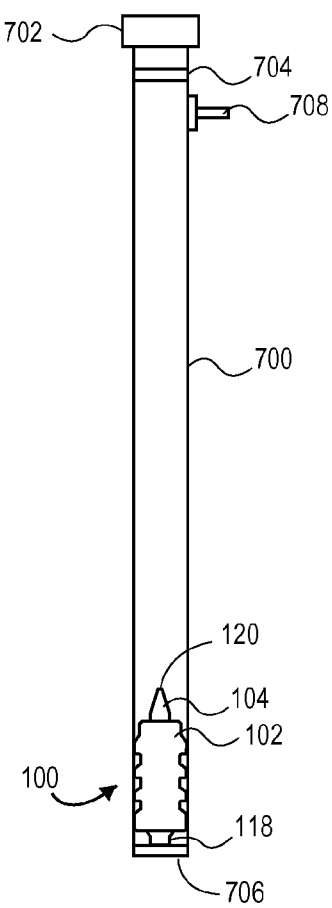

Beginning with the gas lift plunger 100 positioned at or near a distal terminus 706, as shown in FIG. 11A, pressure from gas being produced by the well may build below the gas lift plunger 100, while the valve element 104 is in the closed position (FIG. 1). Since the gas lift plunger 100 may substantially or entirely prevent the fluid below the gas lift plunger 100 from flowing to above the gas lift plunger 100, the pressure below the gas lift plunger 100 may be applied to the second end 108 of the body 102 and/or to the second end 120 of the valve element 104. At some point, this pressure may exceed the weight and friction forces (and/or any other forces) holding the gas lift plunger 100 in place, and the gas lift plunger 100 may move toward an upper terminus 704 (i.e., "ascend"), as shown in FIG. 11B.

Eventually, the gas lift plunger 100 may ascend to the upper terminus 704, e.g., a topside bumper, proximal to the wellhead 702. As shown in FIG. 11C, since the second end 120 of the valve element 104 extends to a position above the second end 108 of the body 102, the second end 120 of the valve element 104 may engage the upper terminus 704 (e.g., topside bumper) before the second end 108 of the body 102. The pressure may continue to be applied to the gas lift plunger 100, such that the body 102 continues to move relative to the valve element 104. Thus, the valve element 104 shifts downward, relative to the body 102, and toward an open position (FIG. 3).

In the open position, the valve-engaging portion 122 is separated from the valve seat 114, thereby allowing fluid communication through the bore 110. This may alleviate the pressure on the first end 118 of the valve element 104 and on the first end 106 of the body 102. The valve element 104 and the body 102 may thus begin to descend back toward the bottom. However, in some cases, the valve element 104 may descend more rapidly than the body 102. This may be caused by a variety of factors, including, for example, friction between the tube-engaging structures 116 and the production tubing, aerodynamics and/or relative density (e.g., as between the valve element 104 and the body 102), and/or the like. The body 102 may also be provided with a suitably-sized choke, as will be described in greater detail below, so as to control the rate of decent of the body 102.

Further, in at least one embodiment, a catcher 708 may be provided proximal to the upper terminus 704. It will be appreciated that the catcher 708 is optional and embodiments are contemplated herein which may not include such a catcher. The catcher 708 may be any suitable device configured to engage and retain the body 102 near the upper terminus 704, while allowing the valve element 104 to descend. As schematically depicted in FIG. 11C, the catcher 708 may be actuated to move radially inward, so as to engage the body 102 and retain the body 102 until moved radially outward again. This may provide a head start for the valve element 104, potentially allowing it to slide entirely out of the bore 110, as shown, such that the body 102 and the valve element 104 descend separately. In other cases, however, the valve element 104 and the body 102 may descend together, with a portion of the valve element 104 being received into the bore 110.

In at least one embodiment, the valve element 104 may, in the open position, slide entirely out of the bore 110 as the body 102 and the valve element 104 may descend toward the distal terminus 706 of the production tubing 700. As shown in FIG. 11D, the valve element 104 may thus reach the distal terminus 706 (e.g., bottom bumper) prior to the body 102. The enlarged, valve-engaging portion 122 being disposed proximal to the first end 118 of the valve element 104 may promote the valve element 104 standing upright in the production tubing 700, despite the valve element 104 being radially smaller than the production tubing 700.

At some later point, the body 102 may arrive at the distal terminus 706. The bore 110 may then receive the second end 120 of the valve element 104 as the body 102 descends relative to the stationary valve element 104. Further, the tapered portion 128 and/or the valve seat 114 may facilitate receiving the second end into the bore 110, accommodating a range of initial radial positions for the valve element 104 at the bottom of the production tubing.

The body 102 may continue descending relative to the production tubing and the valve element 104, until the valve seat 114 is once again engaged by the valve-engaging portion 122 of the valve element 104. At this point, pressure may again begin to build below the gas lift plunger 100, and the cycle begins again.

Figure 4:
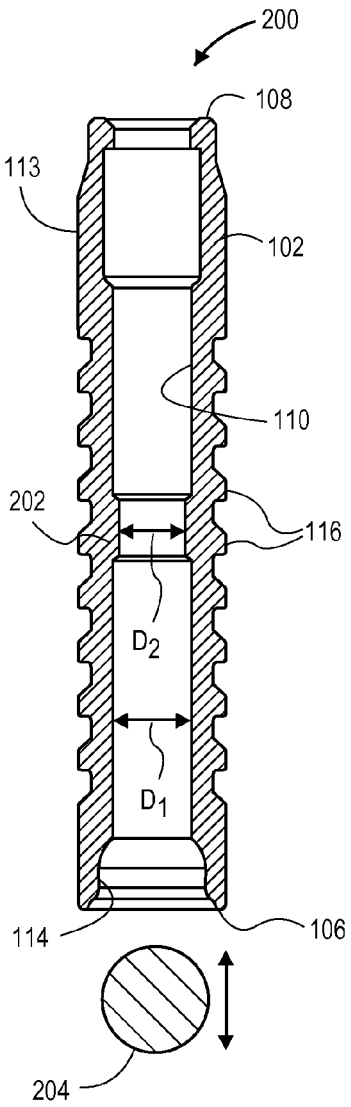
FIG. 4 illustrates a side-cross sectional view of another gas lift plunger, according to an embodiment.

FIG. 4 illustrates a side cross-sectional view of another gas lift plunger 200, according to an embodiment. The gas lift plunger 200 may be generally similar in structure and operation to the gas lift plunger 100, and similar or the same parts may be given like numbers in the figures. The gas lift plunger 200 may, however, also include a choke 202 and may include a different valve element 204, among other potential differences.

The choke 202 may be provided as a shoulder extending into the bore 110, as shown. Accordingly, the choke 202 may represent an area defining a diameter D2 that is less than the nominal diameter D1 of the bore 110. Moreover, the choke 202 may be integral with the remainder of the body 102, or, in other embodiments, may be a separate piece that is secured within the bore 110. In the latter case, a modular assembly may be provided, including, e.g., multiple, differently-sized chokes 202, which may provide multiple configurations of the gas lift plunger 200. Moreover, it will be appreciated that the choke 202 may be positioned at any point between the first end 106 and the second end 108, for example, between the fishing neck 113 and the valve seat 114.

The choke 202 may define a bevel at each end thereof. In some embodiments, the bevel may range from an angle of about 5 degrees, about 10 degrees, or about 15 degrees, to about 45 degrees, about 40 degrees, or about 35 degrees. Further, it will be appreciated that a relatively small reduction in the choke diameter D2 may result in a significant reduction in the flowpath area of the bore 110. In some cases, the choke 202 may be generally tapered along its entire extent, e.g., as a converging, diverging, or converging-diverging nozzle, with or without a flat (in cross-section) throat. Moreover, the choke diameter D2 may range from about 50% to about 95% of the nominal diameter D1 of the bore 110, for example, about 75% of the nominal diameter D1.

The choke 202 may control a rate of descent of the body 102 in the well. In at least one embodiment, the choke 202 may be particularly suitable for use in high-sand conditions, e.g., where hydraulic fracturing is employed to gain access to natural gas reserves embedded in shale. Moreover, the choke 202 may operate to reduce the descent rate of the body 102, relative to the valve element 204, such that the body 102 descends more slowly than the valve element 204.

Turning now to the valve element 204, the valve element 204 may be provided by a spherical ball, or may be any other suitable shape and size. Further, as with the valve element 104, the valve element 204 may be sized and shaped to seat into the valve seat 114 and at least partially seal the bore 110. However, the valve element 204 may not be received through the bore 110 of the body 102, and may be deployed in advance of the body 102. After a predetermined delay, the body 102 may be deployed, with its descent controlled by the choke 202. Thus, the choke 202 may prevent the body 102 from descending at a rate that is near, equal to, or greater than the valve element 204, thereby allowing complete descent of the body 102 and the valve element 204 in the well. Upon reaching the bottom, the body 102 may receive the valve element 204 into the valve seat 114, which may begin the ascent toward the wellhead. Upon reaching the wellhead, a shifting rod, or some other device, may, for example, extend through the second end 108 of the body 102 and dislodge the valve element 204 from the valve seat 114, thereby allowing the valve element 204 to begin its descent toward the bottom of the well once more, with the descent of the body 102 again being limited or otherwise controlled by the choke 202 selection.

In some cases, allowing the valve element 204 to descend may serve to open the bore 110 to fluid communication across the body 102, which may also allow the body 102 to begin its descent, e.g., trailing the valve element 204. In another embodiment, however, the catcher 708 (FIGS. 11A-D) may be provided, so as to retain the body 102 at a position proximal to the upper terminus (e.g., proximal to the topside bumper) of the well for a duration. By catching the body 102, the valve element 204 may descend without the body 102, thereby allowing the body 102 and the valve element 204 to descend separately.

Figure 5:
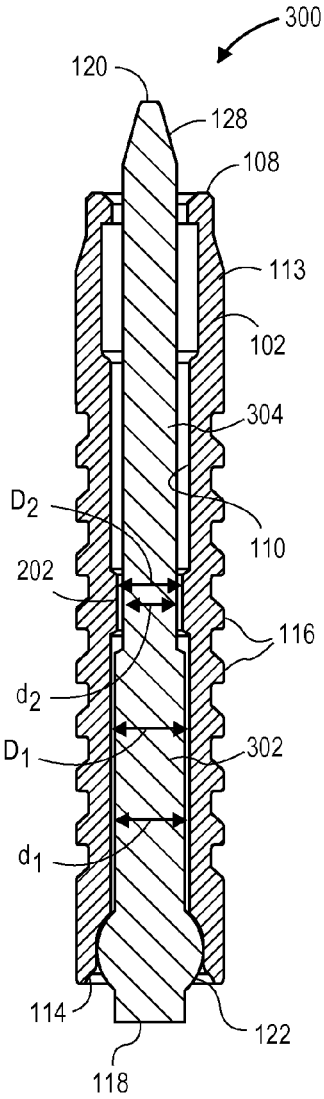
FIGS. 5 and 6 illustrate side-cross sectional views of yet another gas lift plunger, with a valve element thereof in a closed and open position, respectively, according to an embodiment.
Figure 6:
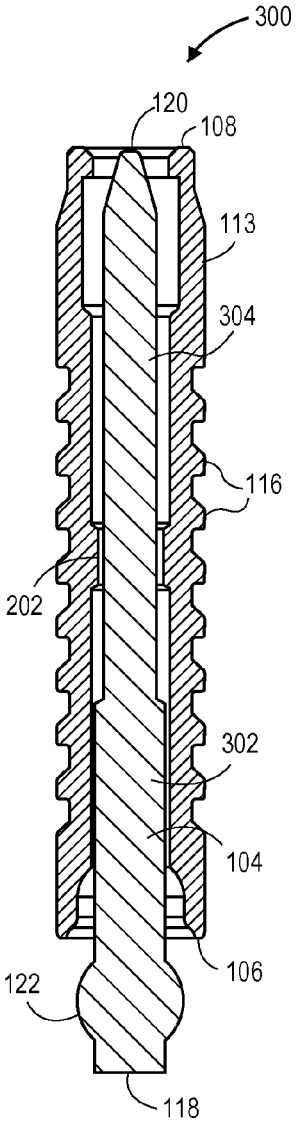

FIGS. 5 and 6 illustrate a side cross-sectional view of another gas lift plunger 300, according to an embodiment. The gas lift plunger 300 may be generally similar to the gas lift plungers 100, 200, and similar elements may have similar reference numbers in the figures. In particular, FIG. 5 illustrates the gas lift plunger 300 with the valve element 104 in the closed position, and FIG. 6 illustrates the gas lift plunger 300 with the valve element 104 in an open position. Further, the gas lift plunger 300 may include the valve element 104, shaped, in this embodiment, as a rod extending through the bore 110 of the body 102. Additionally, the body 102 may include the choke 202, e.g., as provided in the gas lift plunger 200 (e.g., FIG. 4).

In this embodiment, the valve element 104 may include a first portion 302 and a second portion 304. The first portion 302 may define a first diameter d1, and the second portion 304 may define a second diameter d2. The first diameter d1 may be smaller than the nominal diameter D1 of the bore 110, but larger than the diameter D2 of the bore 110 at the choke 202. The second diameter d2 may be smaller than the diameter D2 of the bore 110 at the choke 202, such that the second portion 304 may be able to slide past the choke 202. The first portion 302 may, however, be too large to fit past the choke 202. The first and second portions 302, 304 may combine to form the main portion 126 (FIG. 1) of the valve element 104, or one or more additional portions may be provided.

Further, the first portion 302 may extend from the valve-engaging portion 122, and the second portion 304 may extend from the first portion 302 to the tapered portion 128. Accordingly, the second portion 304 may be disposed between the second end 120 of the valve element 104 and the first portion 302, while the first portion 302 may be disposed between the valve-engaging portion 122 and the second portion 304. Additionally, the first portion 302 may have a length that is shorter than a distance between the bottom of the valve seat 114 and the choke 202. As such, the first portion 302 may avoid engaging the choke 202, and may allow the valve-engaging portion 122 to engage and/or seal with the valve seat 114.

The gas lift plunger 300 may function similarly to a combination of the gas lift plunger 100 and the gas lift plunger 200. Thus, again referring to FIGS. 11A-D, in an embodiment, the second end 120 of the valve element 104 may engage a bumper at the upper terminus 704, causing the valve-engaging portion 122 to disengage and be separated from the valve seat 114. This may move the valve element 104 from the closed position (FIG. 5) to an open position (FIG. 6). The gas lift plunger 300 may then begin descending in the production tubing 700, with the valve element 104 having, e.g., a higher rate of descent or otherwise preceding the body 102. Such separation and/or independent descent of the valve element 104 from the body 102 may also be part of the open position of the valve element 104.

Once reaching the distal terminus 706 (e.g., as shown in FIG. 11D), the valve element 104 may remain upright, and the body 102 may receive the valve element 104 into the bore 110. Continued travel of the body 102 relative to the valve element 104 may eventually cause the valve seat 114 to seal with the valve-engaging portion 122. This may result in pressure building below the gas lift plunger 300, causing the gas lift plunger 300 to begin its ascent again.

Figure 7:
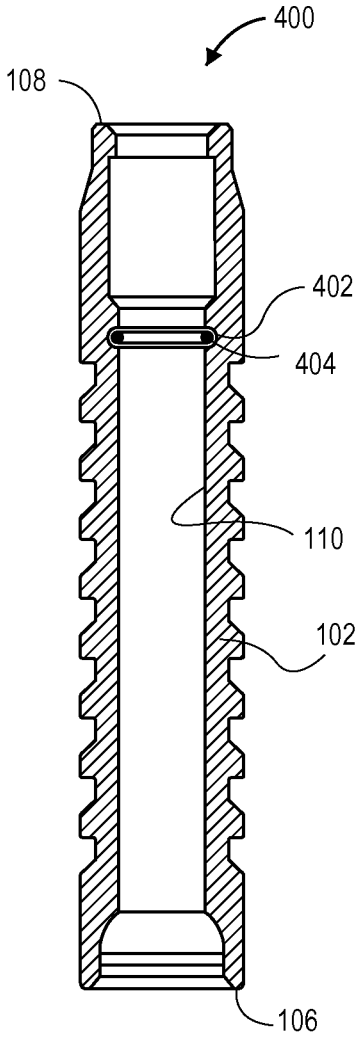
FIGS. 7 and 8 illustrate side-cross sectional views of a body of still another gas lift plunger, and the body and valve element of the gas lift plunger, respectively, according to an embodiment.

FIG. 7 illustrates a side cross-sectional view of another gas lift plunger 400, according to an embodiment. The gas lift plunger 400 may be generally similar to the gas lift plunger 100, although, in some embodiments, it may also include the choke 202 (FIG. 4). The gas lift plunger 400 may further include a groove 402, which may extend outward from the bore 110. A friction-increasing member 404, such as an elastomeric (e.g., O-ring) seal, a snap ring, or the like, may be disposed in the groove 402, and may extend into the bore 110. The groove 402 may be disposed proximal to the second end 108, e.g., closer to the second end 108 than to the first end 106. In some cases, as shown, the fishing neck 113 (and/or the choke 202) may be disposed between the groove 402 and the second end 108, while the groove 402 may be considered proximal to the second end 108.

Figure 8:
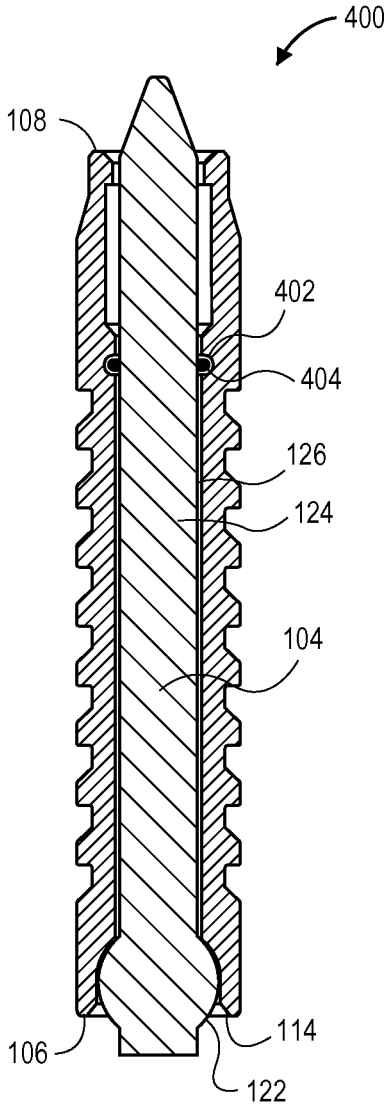

As shown in FIG. 8, the friction-increasing member 404 may be configured to engage the valve element 104. For example, the friction-increasing member 404 may engage the outer diameter 124 of the main portion 126 of the valve element 104, at least when the valve element 104 is in the closed position. As the valve element 104 moves toward the open position, e.g., downward relative to the body 102 and, e.g., out of the bore 110, the valve element 104 may be disengaged from the friction-increasing member 404. Accordingly, the friction-increasing member 404 may promote a slower transition to the open position, thereby potentially avoiding or at least mitigating early valve opening in low-flowrate wells as the gas lift plunger 400 reaches the upper terminus of its ascent (e.g., proximal to the topside bumper). A well having a low flowrate may be one having a flowrate of less than about 400 MCF per day, for example.

Figure 9:
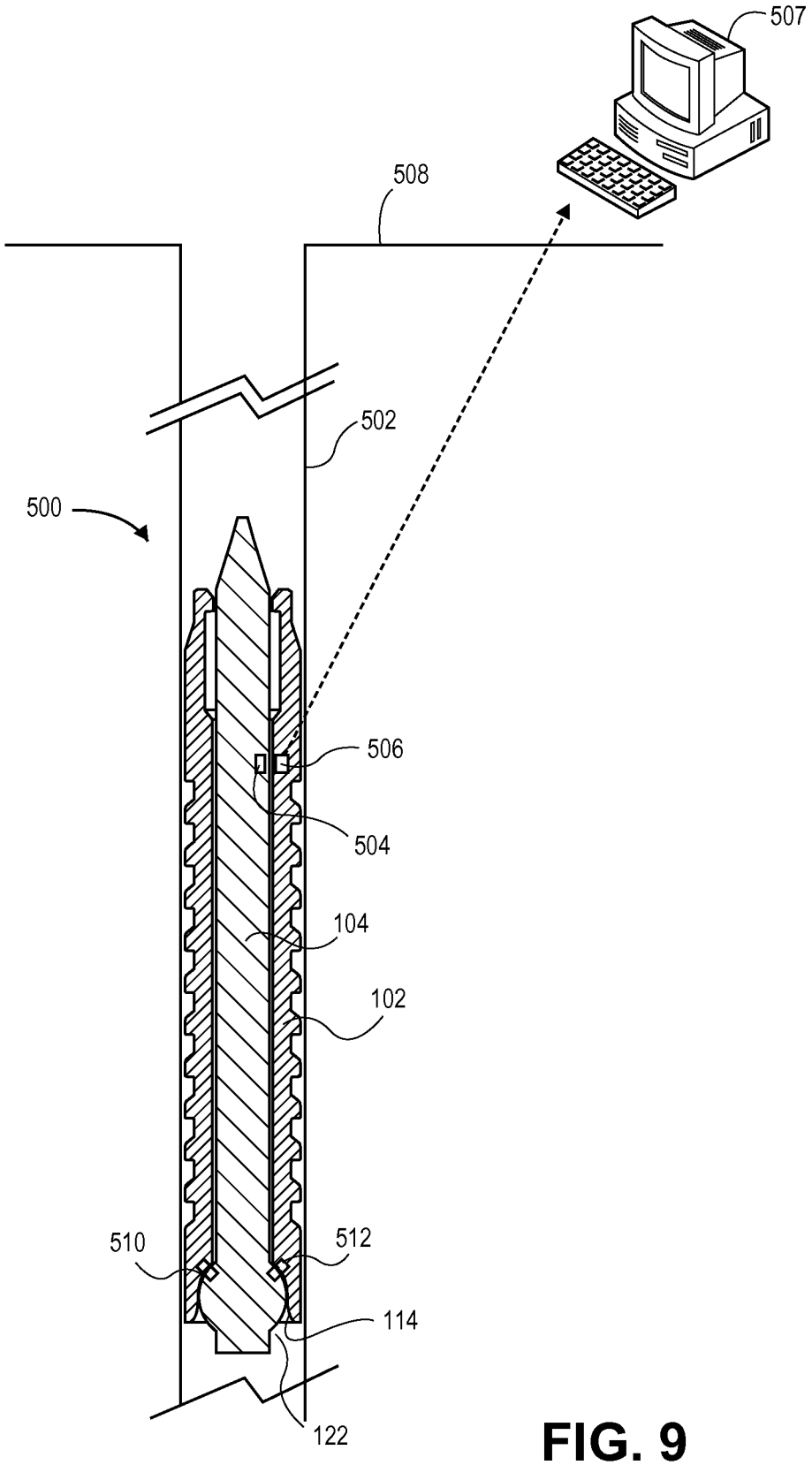
FIG. 9 illustrates a schematic view of a gas lift plunger disposed in a well, according to an embodiment.

FIG. 9 illustrates schematic view of another gas lift plunger 500, disposed in a well 502, according to an embodiment. The well 502 is depicted in simplified schematic form, for purposes of illustrating one potential embodiment and/or operation of the gas lift plunger 500 therein, and it will be appreciated that the sides of the well 502 illustrated may be representative of or include production tubing, casing, and/or any other suitable tubular, other structures, etc. The gas lift plunger 500 may be generally similar to one or more embodiments of the gas lift plungers 100, 300, and/or 400, and thus may include the body 102, defining the bore 110. The valve element 104 may be received through the bore 110, at least when the valve element 104 is in the closed position, e.g., when the valve-engaging portion 122 engages (e.g., seals with) the valve seat 114.

In addition, the valve element 104 may include a first sensor element 504, and the body 102 may include a second sensor element 506. The first and second sensor elements 504, 506 may cooperate to provide data indicative of a relative position of the valve element 104 and the body 102. For example, the first and second sensor elements 504, 506 may provide an indication of when the valve element 104 is in a closed position. In other embodiments, the first and second sensor elements 504, 506 may provide an indication of when the valve element 104 is in an open position, is entirely out of the bore 110, or is positioned in any other location relative to the body 102.

In a specific example, the first sensor element 504 may be a radio-frequency identification (RFID) tag. Accordingly, the second sensor element 506 may be an RFID tag reader. As is generally known in the art, when an RFID tag is brought into a certain proximity (the proximity may be highly variable depending on the type of RFID tag and/or reader), the RFID tag reader may read an identifier from the RFID tag. In an embodiment of the gas lift plunger 500, the second sensor element 506 may read the identifier from the first sensor element 504 when the two are in proximity to one another, which may provide an indication that the first sensor element 504 is aligned, or nearly aligned, with the second sensor element 506. Depending on the position of the first and second sensor elements 504, 506, such alignment may indicate that the valve element 104 is in the closed position, has left the closed position, has left the bore 110, is at any position therebetween, etc.

Moreover, either or both of the first and second sensor elements 504, 506 may include or be coupled with a transmitter. The transmitter may transmit information collected by the first and/or second sensor elements 504, 506 to a computing system 507, as schematically depicted in FIG. 9. The computing system 507 may be fitted with a receiver and located, e.g., at the surface 508. Any suitable wireless telemetry or wired communication process, protocol, devices, etc., may be employed. In other cases, the sensor elements 504, 506 may not include such a transmitter, and may instead include a memory. The memory may count the number of times the sensor elements 504, 506 are aligned, and thus may provide an accurate depiction of the operation of the gas lift plunger 500. For example, if the duration of operation and cycle time are known, then a certain number of closed position counts would be expected; the memory may thus be read to determine if the gas lift plunger 500 is reaching fully closed as expected, cycling as expected, or otherwise operating as expected. In some embodiments, memory and a transmitter may both be provided.

A variety of uses for such sensor elements 504, 506 may be appreciated by one of ordinary skill in the art. Moreover, one of ordinary skill in the art will appreciate that the first sensor element 504 may include the RFID tag reader, while the second sensor element 506 may include the RFID tag (e.g., reverse of the embodiment described above). Further, instead of or in addition to RFID tags, the sensor elements 504, 506 may include a magnet and a magnetic field sensor (e.g., a Hall-effect sensor), an eddy current sensor, or any other type of sensor which may provide similar information to the RFID tag/reader embodiment discussed above. Additionally, it will be appreciated that the gas lift plunger 500 may include the choke 202 (e.g., FIG. 2).

The gas lift plunger 500 may also include one or more magnets 510, 512. For example, the valve element 104 may include a magnet 510 proximal to the valve-engaging portion 122, or at any other point therein. Additionally or instead, the body 102 may include the magnet 512 at the valve seat 114, or at any point along the bore 110. The magnets 510, 512 may be electromagnets, and may be energized when, for example, the sensor elements 504, 506 indicate that the valve element 104 is in the closed position, so as to retain the valve element 104 in the closed position.

Figure 10:
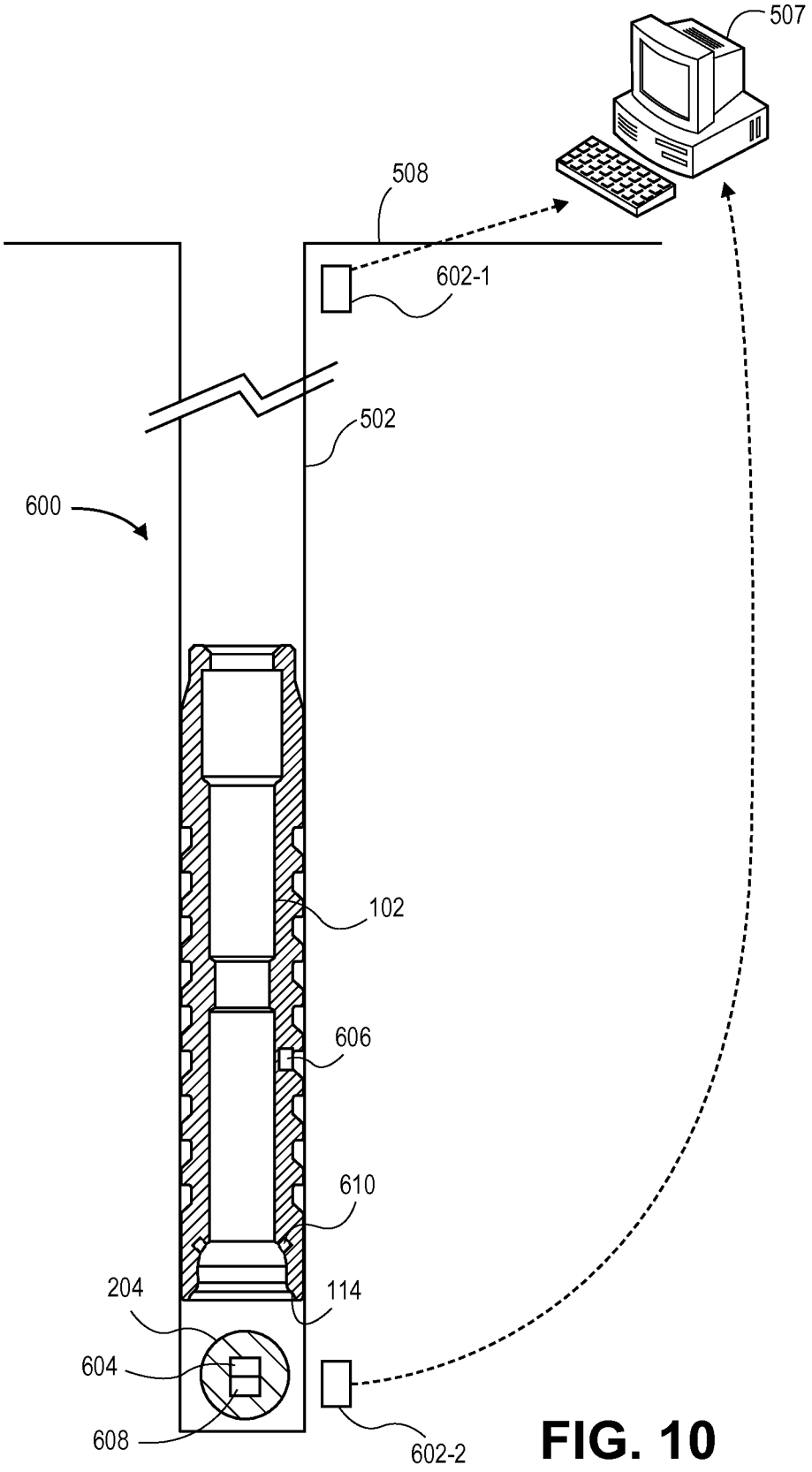
FIG. 10 illustrates a schematic view of another gas lift plunger disposed in the well, according to an embodiment.

FIG. 10 illustrates a simplified schematic view of another gas lift plunger 600, deployed into the well 502, according to an embodiment. As shown, the well 502 (e.g., the production tubing) may include one or more third sensor elements 602

(e.g., 602-1, 602-2). The sensor elements 602 may be RFID tags and/or readers. For example, one of the third sensor elements 602-1 may be disposed at or proximal to the surface 508, while another one of the third sensor elements 602-2 may be disposed at or proximal to the bottom of the well, e.g., at a bottom assembly of the production tubing. It will be appreciated that one or more other third sensor elements 602 may be disposed at any point along the well 502.

The valve element 204, which may be a ball as described above with reference to FIG. 4, may include a second sensor element 604, which may also be an RFID tag or reader. Further, the body 102 may include a first sensor element 606, which may be an RFID tag or reader. Accordingly, a position of the valve element 204 relative to the body 102 and/or relative to the well 502 may be determined. For example, the third sensor elements 602-1, 602-2 may be configured to read a unique identifier from the first and second sensor elements 606, 604 and may include or be coupled with a transmitter that may send a signal to the computing system 507, indicating when the valve element 204 and/or the body 102 is proximal thereto. Accordingly, the sensor elements 602, 604, 606, e.g., depending on the positioning of the third sensor elements 602, may indicate when either or both of the valve element 204 and/or the body 102 is proximal to the bottom of the well 502 and/or to the surface 508.

Additionally, one or both of the body 102 and the valve element 204 may include magnets 608, 610, which may be or include permanent magnets and/or electromagnets. For example, the body 102 may include the magnet 610 proximal the valve seat 114. Accordingly, in an embodiment, the magnet 610 may attract the valve element 204, serving to keep the valve element 204 into the closed position until firmly dislodged at the upper terminus 704. In another embodiment, when it is determined, e.g., via the sensor elements 602, 604, and/or 606, that the body 102 and valve element 204 are at or near to the distal terminus of the well 502, the magnet 608 may be energized, so as to attract to the valve element 204 into the valve seat 114. This may assist in securing the valve element 204 in the closed position. When it is determined, again, e.g., via the sensor elements 602, 604, and/or 606, that the body 102 and valve element 204 are proximal the surface 508 (e.g., the upper terminus), the magnet 608 may be disengaged. The magnet(s) 608 and/or 610 may be controlled from the computing system 507 and/or may be controlled locally, e.g., using a processor located on board the body 102, valve element 204, etc.

It will be readily appreciated that the valve element 204 may be substituted with the valve element 104 (see, e.g., FIG. 1). In such case, the valve element 104 may include the second sensor element 604 and/or the magnet 608. Further, the magnet 608 may be positioned at the valve-engaging portion 122, or at any other position along the valve element 104, while the magnet 610, if present in the body 102, may be positioned at the valve seat 114, or at any other point along the bore 110. Moreover, the body 102 may or may not include the choke 202 (e.g., FIG. 4) in this embodiment.

Referring again to FIGS. 11A-D, the catcher 708 may be actuated in response to a variety of triggers. For example, the production tubing 700 and/or gas lift plunger 100 may include the sensor elements 504, 506, 602, 604, and/or 606, as described above, which detect and relay an indication of the position of the body 102 and/or valve element 104 to a computing system 507 (see, e.g., FIGS. 9 and 10). The computing system 507 may, in turn, signal the catcher 708 to actuate when the gas lift plunger 100 approaches the upper terminus 704. In another embodiment, the engagement of the valve element 104 with the upper terminus 704, or the release of pressure from below the gas lift plunger 100 caused by the movement of the valve element 104 to the open position, may serve as the trigger for the catcher 708 to actuate. In still other embodiments, the cycle of the gas lift plunger 100 descent and ascent may be timed, with the catcher 708 actuated at a particular time when the gas lift plunger 100 is expected to be proximal the upper terminus 704. In still other embodiments, the actuation of the catcher 708 may be manually controlled, e.g., by a user according to any one of a variety of observed factors or events. Thus, it will be appreciated that a variety of different triggers may be provided to determine and/or cause actuation of the catcher 708 to catch and/or retain the body 102.

Figure 12:
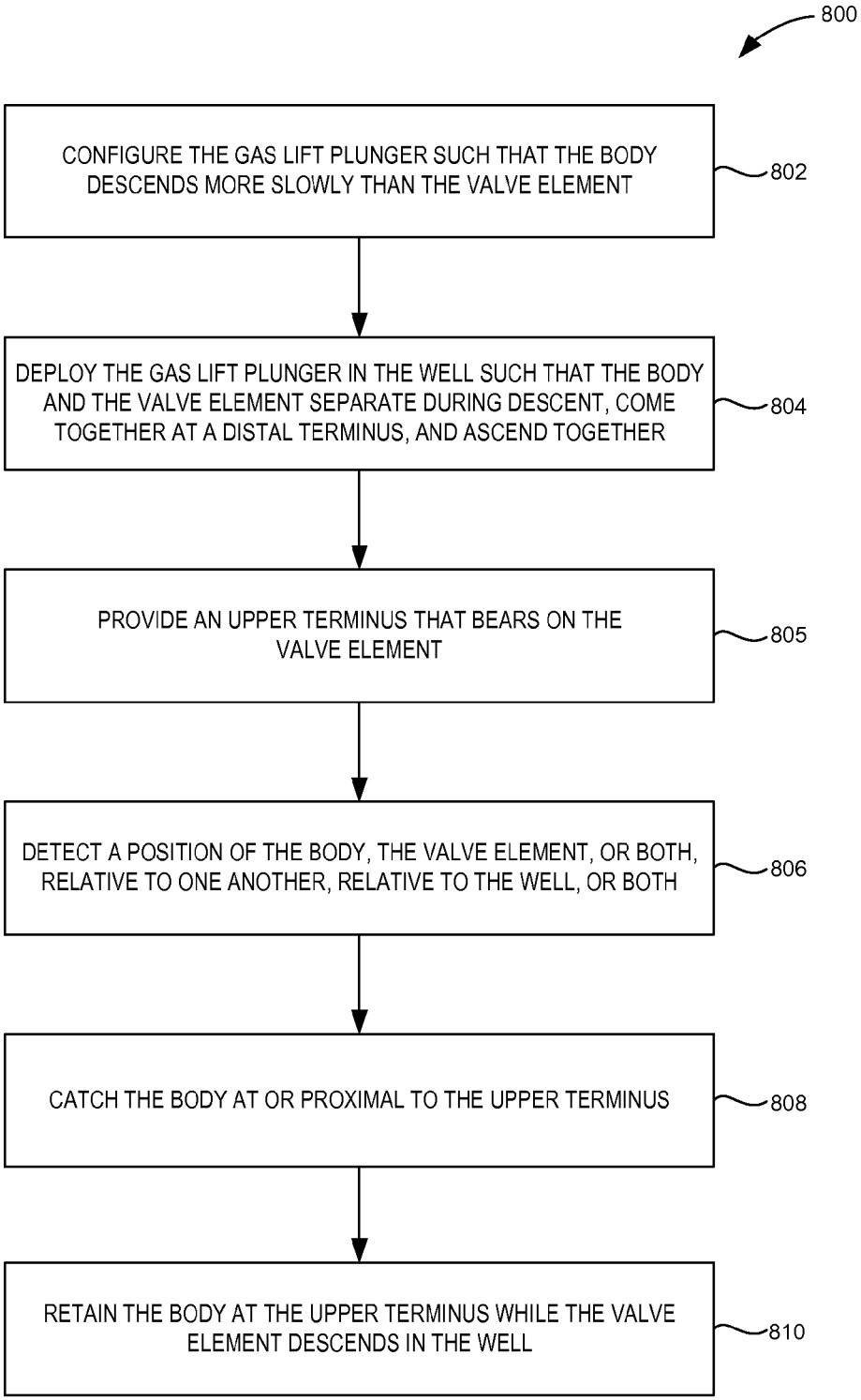
FIG. 12 illustrates a flowchart of a method for lifting gas from a wellbore, according to an embodiment.

FIG. 12 illustrates a flowchart of a method 800, e.g., for lifting gas from a well, according to an embodiment. The method 800 may proceed, in an embodiment, by operation of one or more embodiments of the gas lift plunger 100, 200, 300, 400, 500, or 600, and thus is described herein with reference thereto. However, the method 800 is not limited to any particular structure unless expressly stated herein.

The method 800 may begin by configuring the gas lift plunger 100 such that the body 102 thereof descends in the well at a slower rate than the valve element 104 thereof, as at 802. For example, the material from which the body 102 is constructed may be less dense than that of the valve element 104. In addition, the body 102 may have tubular engaging elements 116 that are configured to induce friction with the production tubing, thereby slowing the descent of the body 102. In various embodiments, the bore 110 of the body 102 may be sized to provide a particular rate of descent. In a specific embodiment, the bore 110 may be provided with the choke 202 to provide such reduced descent. In other cases, other structures, processes, material, etc. may be provided to control the rate of descent of the body 102 relative to the valve element 104.

Whether the valve element is provided generally as a ball, as with the valve element 204, or in a rod-shape, as with the valve element 104, the material from which the valve element is selected may depend, among other things, on the size of the choke 202 (and/or the bore 110) provided. For example, and not by way of limitation in any sense, a choke 202 with a 0.625 inch diameter may be used in conjunction with a valve element made from zirconium, a choke 202 with a 0.750 inch diameter may be used in conjunction with a valve element made from steel, a choke 202 with a 0.875 inch diameter may be used in conjunction with a valve element made from cobalt, and a choke 202 with a 1.000 inch diameter choke may be used in conjunction with a tungsten carbide valve element. It will be appreciated, however, that the denser materials may be used with smaller choke 202 diameters.

The method 800 may proceed to deploying the gas lift plunger 100 in the well such that the body 102 and the valve element 104 separate during descent in the well, come together at a distal terminus 704, and ascend together in the well, toward an upper terminus, as at 804. The separation of the valve element 104 and the body 102 may be consistent with an open position of the valve element 104, while the body 102 and the valve element 104 coming together may be consistent with a closed position of the valve element 104. Moreover, an embodiment of this particular example of the operating cycle of the gas lift plunger 100 is discussed above with reference to FIGS. 11A-D. It will be appreciated, however, that the valve element 104 may fall along with the body 102, such that an annulus allowing fluid communication through the body 102 is formed between the valve element 104 and the bore 110, with the valve-engaging portion 122 separated from the valve seat 114.

The method 800 may also include providing an upper terminus 704 that bears on the valve element 104 so as to move the valve element 104 from the closed position back to the open position, as at 805. For example, the upper terminus 704 may provide a flat plate or any other suitable structure that is configured to engage the valve element 104, with the valve element 104 extending completely through the body 102 so as to engage the upper terminus 704 prior to the body 102 reaching the upper terminus 704. In some cases, such engagement may relieve pressure below the body 102, allowing the valve element 104 and the body 102 to again descend, prior to the body 102 reaching the upper terminus 704, such that the body 102 does not reach the upper terminus 704. In other embodiments, the body 102 may continue moving after the valve element 104 engages the upper terminus 704, such that the body 102 also engages the upper terminus 704.

The method 800 may, in an embodiment, also include detecting a position of the body 102, the valve element 104, or both, either relative to one another or relative to the well, as at 806. For example, the gas lift plunger may include sensor elements 504, 506, 602, 604, and/or 606, as described above with reference to FIGS. 9 and 10. Moreover, the position detected may provide for monitoring of operating conditions, deployment of the catcher 708, actuation of magnets 510, 512, 608, and/or 610, and/or any other operation.

Further, the method 800 may, in an embodiment, include catching the body 102 at or proximal to the upper terminus 704, as at 808. For example, the method 800 may include actuating the catcher 708, e.g., according to pressure, timing, detected position, etc. Then, the method 800 may include retaining the body at the upper terminus 704 while the valve element 104 descends in the well, as at 810. In other cases, the catcher 708 and catching at 808 and retaining at 810 may be omitted, with the construction and/or configuration of the body 102 avoiding the body 102 overtaking, or not separating from, the valve element 104 in the well.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A gas lift plunger for use in a wellbore, comprising:

a body comprising a first end, a second end, a valve seat proximal to the first end, and a bore extending between the valve seat and the second end;

a choke disposed within the bore, the choke being configured to control a descent of the body within the wellbore;

a body sensor element coupled to the body, the body sensor element being configured to communicate with a wellbore sensor element disposed in the wellbore;

a valve element configured to be received at least partially into the bore, the valve element being movable in the bore between an open position and a closed position, wherein:

when the valve element is in the closed position, the valve element engages the valve seat, and when the valve element is in the open position, the valve element is separated from the valve seat, to allow fluid communication through the bore; and a device configured to maintain the valve element in the closed position in response to communication between the body sensor element and the wellbore sensor element.

2. The gas lift plunger of claim 1, wherein the valve element is integrally formed.

3. The gas lift plunger of claim 1, wherein the valve element comprises:

a valve-engaging portion configured to seal with the valve seat; and a rod extending from the valve-engaging portion, and wherein the valve element extends through the second end of the body when the valve element is in the closed position.

4. The gas lift plunger of claim 1, wherein the valve element is configured to slide out of the bore when the valve element is in the open position.

5. The gas lift plunger of claim 1, wherein the valve element comprises a tapered portion that terminates at the second end.

6. The gas lift plunger of claim 1, wherein the valve element comprises a first portion having a first diameter that is larger than a diameter of the choke.

7. The gas lift plunger of claim 6, wherein the valve element further comprises a second portion having a second diameter than is smaller than the diameter of the choke, such that the second portion is configured to slide through the choke.

8. The gas lift plunger of claim 7, wherein the second portion is positioned between the first portion and the second end of the valve element, and wherein the first portion is positioned between the second portion and a valve-engaging portion of the valve element.

9. The gas lift plunger of claim 1, wherein the body comprises a friction-increasing member engaging the valve element, to resist movement of the valve element with respect to the body.

10. The gas lift plunger of claim 9, wherein the friction-increasing member comprises an element selected from the group consisting of a seal and a snap ring, the element being coupled with the bore.

11. The gas lift plunger of claim 1, wherein the choke comprises axial ends, at least one of the axial ends being beveled substantially from a location where the choke meets the bore to an inner diameter surface of the choke.

12. The gas lift plunger of claim 11, wherein the at least one of the axial ends comprises a first axial end that faces the second end of the body, away from the valve seat.

13. The gas lift plunger of claim 1, further comprising a fishing neck located proximal to the second end of the body, the fishing neck defining an inner diameter, wherein the inner diameter of the choke is less than the inner diameter of the fishing neck.

14. The gas lift plunger of claim 1, wherein the body sensor element, the wellbore sensor element, or both comprise a radiofrequency identification tag or a radiofrequency identification reader.

15. The gas lift plunger of claim 1, wherein the body sensor element and the wellbore sensor element are configured to communicate with one another to determine a position of the body within the wellbore.

16. The gas lift plunger of claim 1, wherein the device comprises a magnet configured to be energized to attract the valve element when the body is positioned close to a bottom of the wellbore.

17. The gas lift plunger of claim 1, wherein the device comprises a magnet configured to be de-energized to release the valve element when it is determined that the body is positioned close to a top of the wellbore.

18. An apparatus for lifting gas from a well, comprising:

a body comprising a first end and a second end, the body defining a bore extending between and communicating with the first end and the second end, the body comprising:

a valve seat at the first end;

a choke extending into the bore; and a body sensor element coupled to the body, the body sensor element being configured to communicate with a wellbore sensor element disposed in the well;

a valve element movable between an open position and a closed position, wherein:

in the closed position, the valve element engages the valve seat, to substantially prevent fluid flow through the bore;

in the open position, the valve element is separated from the valve seat, allowing fluid to flow through the bore; and a device configured to maintain the valve element in the closed position in response to communication between the body sensor element and the wellbore sensor element.

19. The apparatus of claim 18, wherein the valve element comprises at least part of a sphere that is receivable into the valve seat.

20. The apparatus of claim 18, wherein the valve element comprises a rod extending through the bore and being slidable with respect thereto, wherein the rod slides along at least a portion of the bore when the valve element is in the open position.

21. The apparatus of claim 20, wherein the valve element comprises a valve-engaging portion that is coupled with the rod and engages the valve seat when the valve element is in the closed position.

22. The apparatus of claim 21, wherein the rod further comprises a first end and a second end, wherein the valve-engaging portion is disposed proximal to the first end, and the second end is positioned outside of the bore when the valve element is in the closed position.

23. The apparatus of claim 21, wherein the rod comprises a first portion and a second portion, the first portion defining a first diameter that is larger than a diameter of the choke, and the second portion defining a second diameter that is smaller than the diameter of the choke.

24. The apparatus of claim 18, wherein the choke is integral with the body.

25. The apparatus of claim 18, wherein the choke defines an inner diameter that is less than an inner diameter of the valve seat and less than an inner diameter of the bore.

26. The apparatus of claim 18, wherein the body further comprises a fishing neck proximal to the second end thereof, wherein the inner diameter of the choke is less than an inner diameter of the fishing neck.

27. A method, comprising:

configuring a gas lift plunger such that a valve element thereof descends to a distal terminus of a well before a body of the gas lift plunger, wherein the body defines a bore into which at least a portion of the valve element is received, wherein configuring the gas lift plunger comprises providing a choke extending inwards into a bore of the body;

deploying the gas lift plunger in the well such that the body and the valve element separate proximal an upper terminus of the well, come together, such that the valve element seats in the valve seat, at the distal terminus of the well, and ascend together with the valve element in a closed position; and energizing a device to maintain the valve element in the closed position in response to communication between a body sensor element coupled to the body and a wellbore sensor element disposed in the well.

28. The method of claim 27, wherein the valve element is completely separated from the body during at least a part of a descent of the valve element in the well.

29. The method of claim 27, further comprising catching the body proximal the upper terminus of the well.

30. The method of claim 29, further comprising retaining the body proximal the upper terminus of the well for a predetermined period of time to allow the valve element to descend in the well prior to the body.

31. The method of claim 29, further comprising detecting a position of the body, a position of the valve element, or both, relative to one another, relative to the well, or both.

32. The method of claim 31, wherein catching the body comprises catching the body in response to detecting that the position of the body is proximal to the upper terminus.

33. The method of claim 27, further comprising retaining the valve element in the closed position using a magnet disposed in the body, a magnet disposed in the valve element, or both.

34. The method of claim 27, wherein configuring the gas lift plunger comprises sizing the choke based at least partially on a density of a material from which the valve element is at least partially constructed.

* * * * *